US006722401B1

(12) United States Patent
Brock

(10) Patent No.: US 6,722,401 B1
(45) Date of Patent: Apr. 20, 2004

(54) PAINTBALL CYLINDER REFILLING APPARATUS

(75) Inventor: Otis G. Brock, Suffolk, VA (US)

(73) Assignee: Bauer Compressors, Inc., Norfolk, VA (US)

( * ) Notice: Subject to any disclaimer, the term of this patent is extended or adjusted under 35 U.S.C. 154(b) by 0 days.

(21) Appl. No.: 10/340,064

(22) Filed: Jan. 10, 2003

(51) Int. Cl.[7] ..... B65B 1/04

(52) U.S. Cl. ..... 141/100; 141/18; 141/20; 141/192; 141/197

(58) Field of Search ..... 141/9, 100, 104, 141/37–64, 197, 2, 18, 3, 20, 192, 198; 251/25

(56) References Cited

U.S. PATENT DOCUMENTS 5,148,839 A * 9/1992 Kirwan et al. ..... 141/1
5,806,573 A 9/1998 Kilcoin ..... 141/21
5,937,917 A * 8/1999 Takeyama et al. ..... 141/18
6,158,482 A * 12/2000 Rubin ..... 141/59
6,179,016 B1 1/2001 Neacker et al. ..... 141/21
6,263,927 B1 7/2001 Carroll ..... 141/290

* cited by examiner

*Primary Examiner*—Steven O. Douglas
(74) *Attorney, Agent, or Firm*—Gifford, Krass, Groh, Sprinkle, Anderson & Citkowski, P.C.

(57) ABSTRACT

A paintball cylinder refilling apparatus for installation and use at a paintball field or tournament includes a housing, a high-pressure and a low-pressure fluid source. The housing has a paintball cylinder refill circuit that includes a high-pressure circuit adapted to refill a paintball cylinder and a low-pressure circuit that operates to open and close the high-pressure circuit. The high and low-pressure circuits are also adapted to safely vent into the atmosphere any pressurized fluid that may be resident in either circuit following the termination of a cylinder refilling operation.

9 Claims, 2 Drawing Sheets

PAINTBALL CYLINDER REFILLING APPARATUS

BACKGROUND OF THE INVENTION

1. Field of the Invention

The present invention relates to an apparatus for refilling cylinders. More particularly, the invention concerns an apparatus for refilling high-pressure fluid storage vessels or cylinders of the type used with paintball guns or markers.

2. Reference to Related Art

In the sport of paintball, players can take on the role of enemy combatants. To defeat the opposition, each player uses a pneumatically actuated paintball marker or gun to shoot or otherwise project paint-filled spheres known as paintballs at one another. When a player is struck by a paintball, the paintball shatters splattering the affected player with an amount of paint. Striking a player in this manner can result in the elimination of that player from a game.

Modern paintball guns or markers generally include three elements: 1) the gun; 2) a magazine attached to the gun that holds a supply of paintballs that are fed into the gun; and 3) a pressure supply that is usually maintained at a pressure of 3000–4500 psi and may comprise a fluid cylinder or tank filled with a fluid such as nitrogen, compressed air or high-pressure air (HPA). The pressure supply is attached to the gun and is adapted to provide the gun with the necessary pneumatic power to project a paintball toward one's opponent.

Given the high-pressures used to power a modem paintball marker, it would be advantageous to have a safe and convenient system for refilling a fluid cylinder once that cylinder is exhausted. In recent years, it has been commonplace to have a team of two people involved in a cylinder refilling process, with one person holding a fluid cylinder and/or a quick disconnect fitting and another person controlling the flow of a pressured fluid from a high-pressure supply source to the fluid cylinder. However, the possibility of a fill line or cylinder rupture during the refill process makes this modem two-person practice unsafe since such a rupture might easily result in an injury to all persons involved in the refill process. Therefore, it would be advantageous to have a self-serve cylinder refill apparatus that removes one person from the process of refilling the cylinder and also make the refilling process safe and practical.

SUMMARY OF THE INVENTION

The present invention provides a cylinder refilling apparatus that includes a housing, a high-pressure and a low-pressure fluid source. The housing has a cylinder refill circuit that includes a high-pressure circuit adapted to refill a cylinder and a low-pressure circuit that operates to open and close the high-pressure circuit. More particularly, the high-pressure circuit includes an inlet in communication with the high-pressure fluid source, a normally closed valve in communication with the inlet, a normally open valve in communication with the normally closed valve and an outlet in communication with the normally closed valve.

The low-pressure circuit communicates with (and when charged actuates) the normally open valve and normally closed valve and also includes: an inlet in communication with the low-pressure fluid source; a fill valve; and a muffler in communication with the fill valve. The fill valve is movable between a first and a second position such that moving the fill valve into the second position operates to charge the low-pressure circuit which then actuates the normally closed valve and the normally open valve. Additionally, the high and low-pressure circuits are adapted to safely vent into the atmosphere any pressurized fluid that may be resident in either circuit following the termination of a cylinder refilling operation.

During a refilling operation, a user first connects a fluid cylinder to the high-pressure outlet of the apparatus. The user next takes a position in front of the apparatus, away from the higher pressure source, and depresses the fill valve. When the user depresses the fill valve, low-pressure fluid is supplied to both a normally closed valve and a normally open valve in the high-pressure circuit. This action will allow high-pressure fluid to flow from the normally closed valve to a check valve. From the check valve the fluid flows to a pressure gauge and the normally open valve (which is closed due to the fill valve being depressed). From the gauge the high-pressure fluid flows through an outlet hose and into the fluid cylinder attached to the hose.

When the gauge indicates a predetermined pressure or the user hears the flow of fluid stop, the user releases the fill valve. When the user releases the fill valve, the fluid in the low-pressure circuit that is supplied to the normally closed valve and the normally open valve is vented through a muffler and into the atmosphere. Venting of the low-pressure fluid in this manner causes the normally closed valve to close and the normally open valve to open. This action will cause high-pressure fluid to stop flowing to the outlet hose and will allow pressure in the high-pressure circuit to be vented through the normally open valve and a muffler. At this time the filling process is complete and the user can disconnect the cylinder from the hose without the fear of the hose being pressurized.

The present invention for a self-serve cylinder refill apparatus provides a safe and practical means of refilling high-pressure cylinders that may be attached to paintball markers. The invention has several advantages. For example, the present invention allows a single user to conduct a fluid cylinder refill operation while positioned a safe distance from either the high-pressure fluid source or the fluid cylinder. This ability to allow remote refilling of fluid cylinders increases safety and decreases the possibility of injury in the event of a rupture.

BRIEF DESCRIPTION OF THE DRAWING

A better understanding of the present invention will be had upon reference to the associated drawings, wherein like reference numbers refer to like parts throughout and wherein.

DETAILED DESCRIPTION

Figure 1:
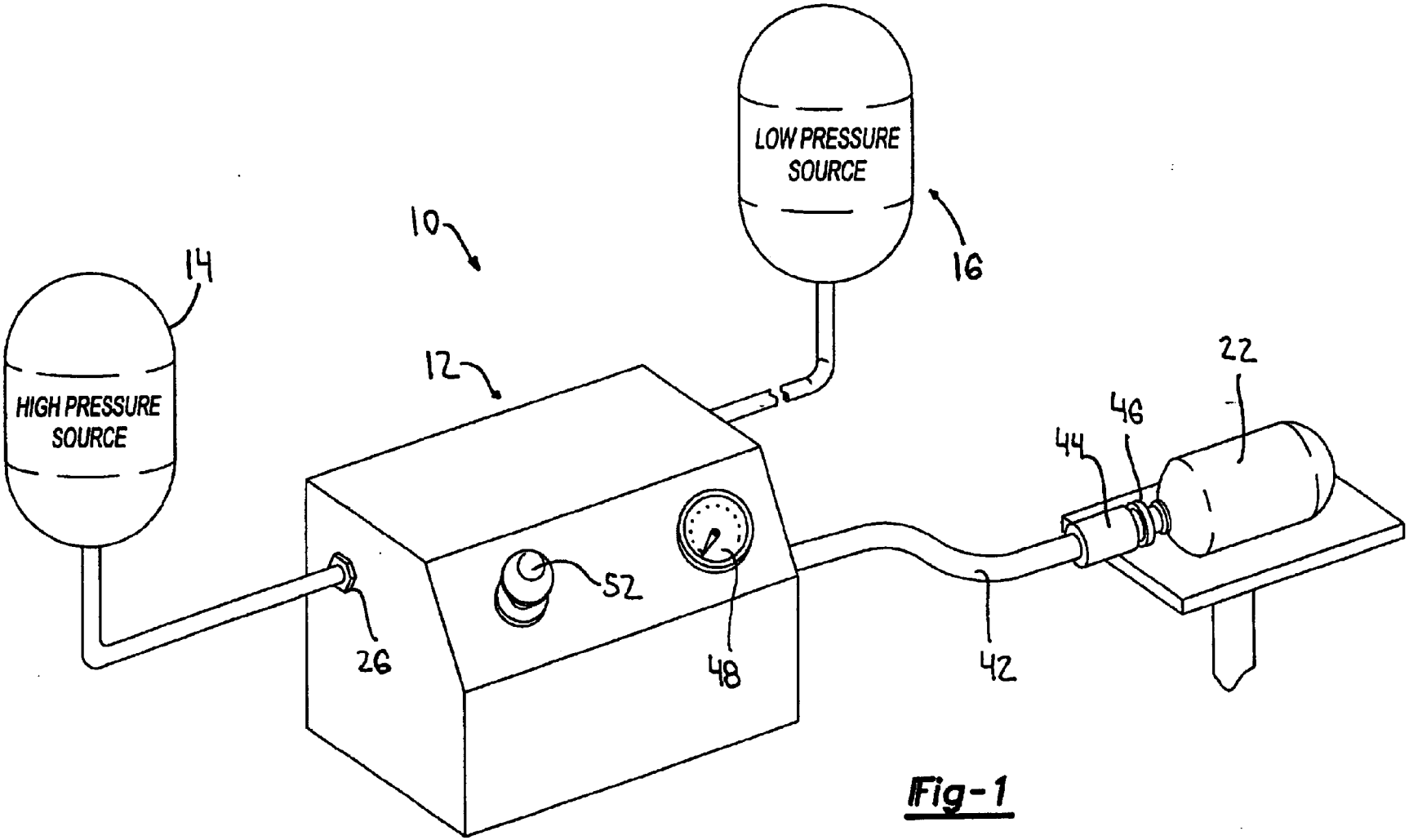
FIG. 1 is a perspective view of a cylinder refill apparatus constructed in accordance with the present invention.
Figure 2:
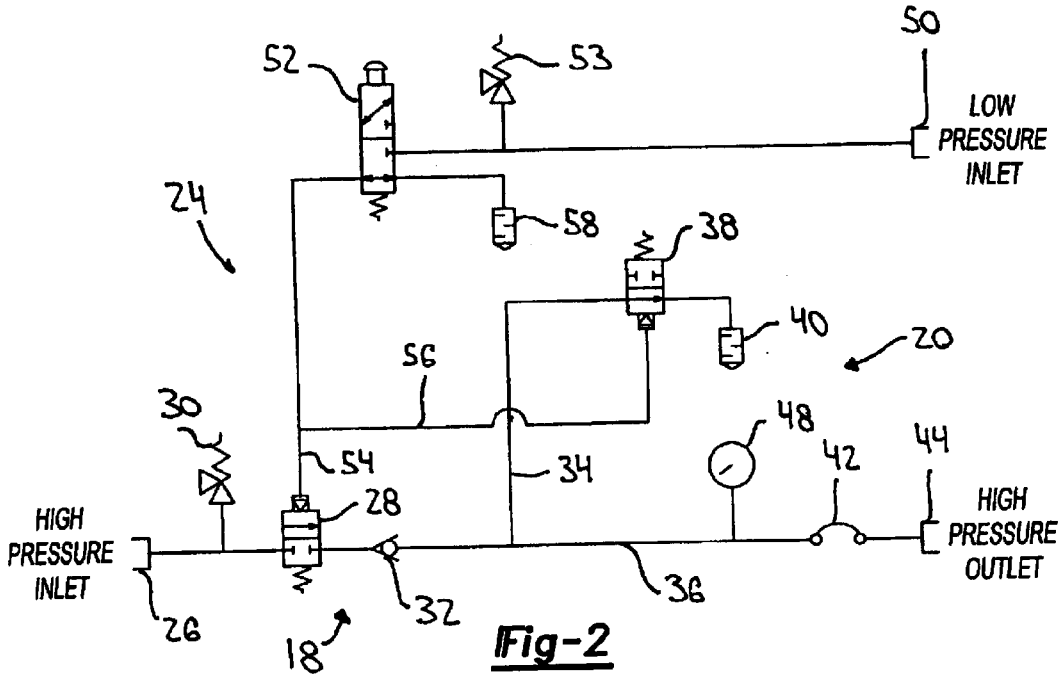
FIG. 2 is a diagrammatic view of a cylinder refill circuit in the closed position.
Figure 3:
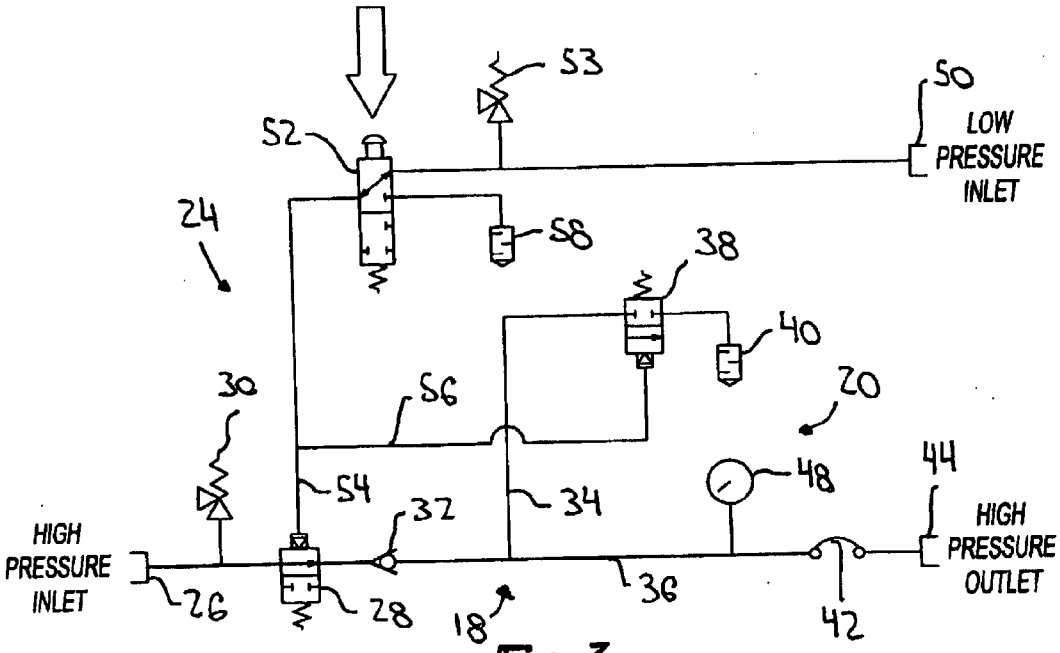
FIG. 3, is a diagrammatic view of a cylinder refill circuit in an open position.

Referring now to FIGS. 1–3, there is shown a cylinder refilling apparatus 10 that includes a housing 12, a high-pressure fluid source 14 and a low-pressure fluid source 16. The high 14 and low 16 pressure sources each store a pressurized fluid (e.g., nitrogen, compressed air, high-pressure air, $CO_2$, etc.). Preferably, the high-pressure fluid is stored at a pressure between 3000–4500 psi. The housing 12 has a paintball cylinder refill circuit 18 that includes a high-pressure circuit 20 adapted to refill a paintball cylinder 22 (e.g., a fluid storage cylinder or tank) and a low-pressure circuit 24 that operates to open and close the high-pressure circuit 20. As discussed below, the high 20 and low 24 pressure circuits are also adapted to safely vent into the atmosphere any pressurized fluid that may be resident in either circuit 20, 24 following a paintball cylinder 22 refilling operation.

Referring now to FIGS. 2 and 3, there is shown the paintball cylinder refill circuit 18 in a discharge or closed configuration (FIG. 2) and in a charged or open configuration (FIG. 3). The high-pressure circuit 20 of the paintball cylinder refill circuit 18 preferably includes a high-pressure inlet 26 in communication with the high-pressure source 14. The high-pressure inlet 26 communicates with a normally closed valve 28. As will be discussed below, the normally closed valve 28 is controlled by the charging or discharging of the low-pressure circuit 24.

A high-pressure relief valve 30 is positioned between and communicates with the high-pressure inlet 26 and the normally closed valve 28 such that fluid in or flowing from the high-pressure source 14 to the normally closed valve 28 is maintained at or below a predetermined safe pressure level. A check valve 32 is disposed immediately downstream of and communicates with the normally closed valve 28 to prohibit backflow of fluid through the normally closed valve 28.

Downstream of the check valve 32, the high-pressure circuit 20 is divided into a first 34 and a second 36 branch. The first branch 34 of the high-pressure circuit 20 preferably includes a normally open valve 38 with a vent or muffler 40 positioned downstream of the normally open valve 38. As will be discussed below, the normally open valve 38 is controlled by the charging or discharging of the low-pressure circuit 24. As seen in FIG. 2, during a discharge operation (or when the high-pressure circuit 20 is not otherwise being charged) the normally open valve 38 functions to communicate pressurized fluid resident in the high-pressure circuit 20 to the muffler 40, which then vents the fluid into the atmosphere. Furthermore, as seen in FIG. 3, during a charging operation the normally open valve 38 is closed.

As shown in FIGS. 1, 2 and 3, an outlet hose 42 is positioned downstream of the second branch 36 of the high-pressure circuit 20. The outlet hose 42 includes a high-pressure outlet 44 having a fitting 46 that is removably securable to the paintball cylinder 22. A pressure gauge 48 is also positioned downstream of the second branch 36 to allow a user to visually monitor fluid pressure in the high-pressure circuit 20 whenever the high-pressure circuit 20 is engaged in a charging (refilling) operation.

Referring now to FIGS. 2 and 3, the low-pressure circuit 24 includes a low-pressure inlet 50 that is adapted to communicate fluid from the low-pressure fluid source 16 into the low-pressure circuit 24. A two-position fill valve 52 is positioned downstream of and communicates with the low-pressure inlet 50. As discussed further below, in a first (or closed) position (FIG. 2) the fill valve 52 is adapted to vent pressured fluid resident in the low-pressure circuit 24 into the atmosphere. In a second (or open) position (FIG. 3), the fill valve 52 communicates fluid from the low-pressure inlet 50 into the low-pressure circuit 24.

A low-pressure relief valve 53 is positioned between and communicates with the low-pressure inlet 50 and the fill valve 52 such that fluid in or flowing from the low-pressure source 16 to the fill valve 52 is maintained at or below a predetermined safe pressure level.

Downstream of the fill valve 52, the low-pressure circuit 24 is divided into a first 54 and a second branch 56. Preferably, the first branch 54 of the low-pressure circuit 24 communicates with the normally closed valve 28 of the high-pressure circuit 20. Charging of the low-pressure circuit 24 functions to actuate the normally closed valve 28, moving the valve 28 from the closed (FIG. 2) to the open (FIG. 3) position. Likewise, the second branch 56 of the low-pressure circuit 24 communicates with the normally open valve 38 of the high-pressure circuit 20. Charging of the low-pressure circuit 24 functions to actuate the normally open valve 38, moving the valve 38 from the open (FIG. 1) to the closed (FIG. 2) position. Therefore, as best shown in FIG. 3, it will be appreciated that when a user depresses the fill valve 52, fluid passes from the low-pressure source 16 into the low-pressure circuit 24 where the fluid operates to seal off and charge the high-pressure circuit 20 by simultaneously causing the closing of the normally open valve 38 and the opening of the normally closed valve 28. Once the normally closed valve 28 is opened, pressured fluid is communicated through the high-pressure circuit 20 and into the paintball cylinder 22.

Referring now to FIGS. 2 and 3, the low-pressure circuit 24 includes a vent or muffler 58 that communicates with the low-pressure circuit 24 when the fill valve 52 is placed in the first or closed position. See FIG. 2. By arranging the muffler 58 in this manner, pressured fluid resident in the low-pressure circuit 24 is automatically discharged or vented through the muffler 58 and into the atmosphere following the return of the fill valve 52 from the second or open position (a charging operation) to the first or closed position. Additionally, the discharge or venting of the low-pressure circuit 24 through the muffler 58 functions to return the normally closed valve 28 and normally open valve 38 of the high-pressure circuit 20 to a default condition (FIG. 2). The return of the normally open valve 38 to default condition functions to vent any pressurized fluid in the high-pressure circuit 20 through the muffler 40 of the high-pressure circuit 20 and then into the atmosphere.

Although the refilling system has been described with respect to the refilling of a paintball cylinder. It should be appreciated that the system of the present invention has application in other refilling systems where a cylinder is to be filled from a high pressure fluid source.

Having thus described the invention, various embodiments and improvements will become known to those of skill in the art that do not depart from the scope of the present invention.

I claim:

1. A cylinder refilling apparatus for refilling paintball cylinders comprising:

a high-pressure fluid source;

a low-pressure fluid source; and a housing having a paintball cylinder refill circuit, said paintball cylinder refill circuit including a high-pressure circuit and a low-pressure circuit, said high-pressure circuit having an inlet in communication with said high-pressure fluid source, a normally closed valve in communication with said inlet, a normally open valve in communication with said normally closed valve and an outlet in communication with said normally closed valve;

said low-pressure circuit communicating with said normally open valve and said normally closed valve and having an inlet in communication with said low-pressure fluid source, a fill valve and a muffler in communication with said fill valve, said fill valve being movable between a first and a second position such that moving said fill valve into said second position operates to actuate said normally closed valve and said normally open valve.

2. The cylinder refill apparatus of claim 1, wherein said low-pressure circuit further comprises a pressure relief valve disposed between and in communication with said low-pressure inlet and said fill valve.

3. The cylinder refill apparatus of claim 1, wherein said high-pressure circuit further comprises a pressure relief valve disposed between and in communication with said high-pressure inlet and said normally closed valve.

4. The cylinder refill apparatus of claim 1, wherein said high-pressure circuit further comprises a pressure gauge.

5. The cylinder refill apparatus of claim 1, wherein said high-pressure circuit further comprises a check valve in communication with said normally closed valve, said check valve being adapted to prevent backflow of a fluid in said high-pressure circuit through said normally closed valve.

6. The cylinder refill apparatus of claim 1, wherein said high-pressure circuit further comprises a muffler in communication with said normally open valve.

7. The cylinder refill apparatus of claim 1, wherein said outlet of said high-pressure circuit comprises an outlet hose.

8. The cylinder refill apparatus of claim 7, wherein said outlet hose comprises a fitting that is removably securable to a cylinder.

9. A cylinder refilling apparatus comprising in combination:

a high-pressure fluid source;

a low-pressure fluid source;

a housing having a paintball cylinder refill circuit, said paintball cylinder refill circuit including a high-pressure circuit and a low-pressure circuit, said high-pressure circuit having an inlet in communication with said high-pressure fluid source, a normally closed valve in communication with said inlet, a normally open valve in communication with said normally closed valve and an outlet in communication with said normally closed valve;

said low-pressure circuit communicating with said normally open valve and said normally closed valve and having an inlet in communication with said low-pressure fluid source, a fill valve and a muffler in communication with said fill valve, said fill valve being movable between a first and a second position such that moving said fill valve into said second position operates to actuate said normally closed valve and said normally open valve; and a paintball cylinder removably secured to said outlet of said high-pressure circuit.

* * * * *